US007494349B1

(12) United States Patent
Huang et al.

(10) Patent No.: US 7,494,349 B1
(45) Date of Patent: Feb. 24, 2009

(54) INPUT/OUTPUT PORT SWITCH STRUCTURE OF ELECTRONIC DEVICE

(75) Inventors: Cheng Ho Huang, Taipei (TW); Hung Lin Chang, Shulin (TW)

(73) Assignee: Elitegroup Computer Systems Co., Ltd., Taipei (TW)

( * ) Notice: Subject to any disclaimer, the term of this patent is extended or adjusted under 35 U.S.C. 154(b) by 0 days.

(21) Appl. No.: 12/000,943

(22) Filed: Dec. 19, 2007

(30) Foreign Application Priority Data

Aug. 31, 2007 (TW) ..... 96132633 A

(51) Int. Cl.
*H01R 13/44* (2006.01)

(52) U.S. Cl. ..... 439/131; 439/172; 439/52

(58) Field of Classification Search ..... 439/52, 439/131, 139, 145, 172, 174, 217, 222; 361/737, 361/752

See application file for complete search history.

(56) References Cited

U.S. PATENT DOCUMENTS 6,793,509 B2 * 9/2004 Chen ..... 439/136
6,808,400 B2 * 10/2004 Tu ..... 439/131
6,908,038 B1 * 6/2005 Le ..... 235/492
6,923,666 B1 * 8/2005 Liao ..... 439/172

* cited by examiner

*Primary Examiner*—Khiem Nguyen
(74) *Attorney, Agent, or Firm*—Rosenberg, Klein & Lee

(57) ABSTRACT

The invention provides an input/output port (I/O port) switch structure of an electronic device. The electronic device comprises a motherboard, and an opening is installed on a predetermined position of the electronic device. The switch structure is installed on the motherboard of the electronic device and a corresponding opening is installed on a side of the electronic device. The I/O port switch structure comprises a base and an operation unit, wherein the base is electrically connected to the motherboard and is used for installing a plurality of I/O ports with different functions. The operation portion is connected to the base to let the base perform a rotating motion at a predetermined angle, and the user can therefore switch and use the required I/O port by operating switch elements.

9 Claims, 8 Drawing Sheets

INPUT/OUTPUT PORT SWITCH STRUCTURE OF ELECTRONIC DEVICE

BACKGROUND OF THE INVENTION

1. Field of the Invention

The present invention relates to an input/output port (I/O port) switch structure of an electronic device, especially relates to the switch structure capable of reducing the opening space required by a plurality of I/O ports.

2. Descriptions of the Related Art

Referring to FIG. 1, a schematic view of a conventional I/O port opening arrangement of a notebook computer is illustrated. According to the figure, a notebook computer 1 comprises a motherboard 11 used to connect with a plurality of I/O ports, such as a mouse port 21, an RS232 interface port 22, a digital visual interface (DVI) port 23, a CRT port 24 and so on. The openings of these I/O ports are installed on the side 12 of the notebook computer 1, and according to the figure, the side 12 of the notebook computer 1 is almost occupied by the I/O port openings.

With the development of peripheral techniques, more and more I/O ports are designed, especially the image signal I/O port. However, the installation of the conventional opening is usually limited by the volume of the notebook computer that is unable to contain many I/O ports. If too many openings are reluctantly installed on the side of the notebook computer, this will not only affect the appearance and the casing strength of the notebook computer but also increase the molding cost.

To overcome the foregoing shortcoming of providing more I/O ports on the notebook computer and reducing the amount of the openings on the side of the notebook computer, the inventor(s) based on years of experience in the related field to conduct extensive researches and experiments, and finally provide an I/O port switch structure of an electronic device to be an achieving method and a basis of the forward hope according to many years research and many experiences, and through multilateral monographic studies and conferences.

SUMMARY OF THE INVENTION

Accordingly, an objective of the invention is to provide an I/O port switch structure of an electronic device, and more particularly to integrate several I/O ports into a base to reduce the amount of the openings required by a plurality of I/O ports and to achieve the effect of using different I/O ports on the same opening of the electronic device.

In order to achieve the foregoing objective, the invention provides an I/O port switch structure of an electronic device, wherein the electronic device comprises a motherboard and an opening. The I/O port switch structure comprises a base and an operation portion. The base has several I/O ports with predetermined arrangement, and is connected to the motherboard through a cable. The operation portion is connected to the base to let the base perform a rotating motion at a predetermined angle so as to switch one of the I/O ports corresponding to the opening.

The operation portion can use a power driving method or a mechanical driving method to enable the base to perform the rotating motion upon demands.

Besides, the I/O port switch structure of the electronic device can further comprise a rotating limiting structure for restricting the rotating angle of the base and preventing the I/O port switch structure from being damaged through improper operations of users.

Furthermore, the I/O port switch structure comprises a cover plate upon demands. When the I/O port aligns the opening, the opening can be approximately sealed by the cover plate to keep a better appearance of the electronic device.

To let examiners further understand and realize the technical features and the effect of the invention, what follows in the passage provides preferably embodiments and related figures for assist and describes in detailed specifications as below.

DESCRIPTION OF THE PREFERRED EMBODIMENT

For the convenience of understanding, the below embodiment of the I/O port switch structure of the electronic device according to the invention uses the same component numeral as the forward embodiment.

Figure 1:
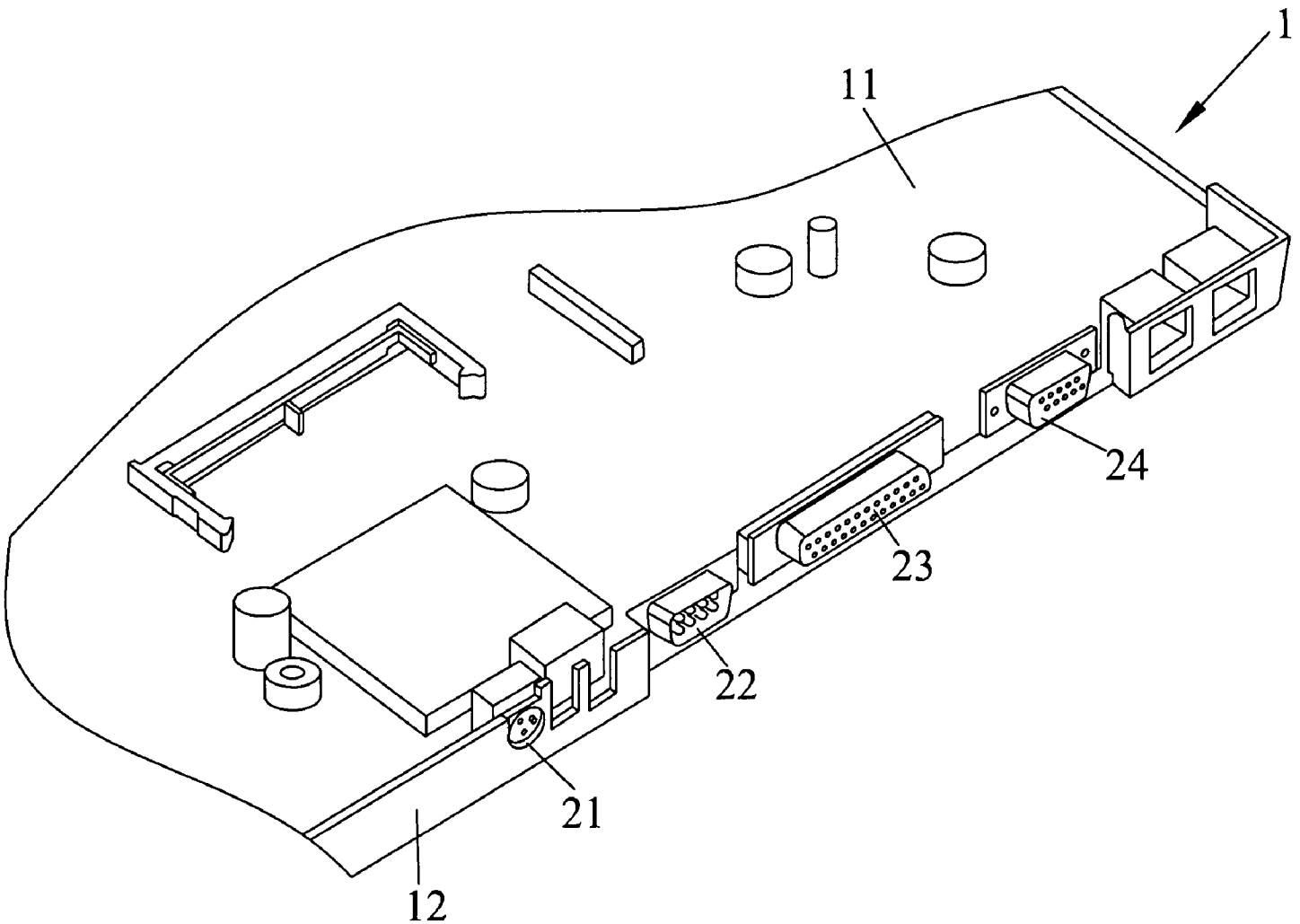
FIG.1 (PRIOR ART)
FIG. 1 is a schematic view showing a conventional I/O port opening arrangement of a notebook.
Figure 2A:
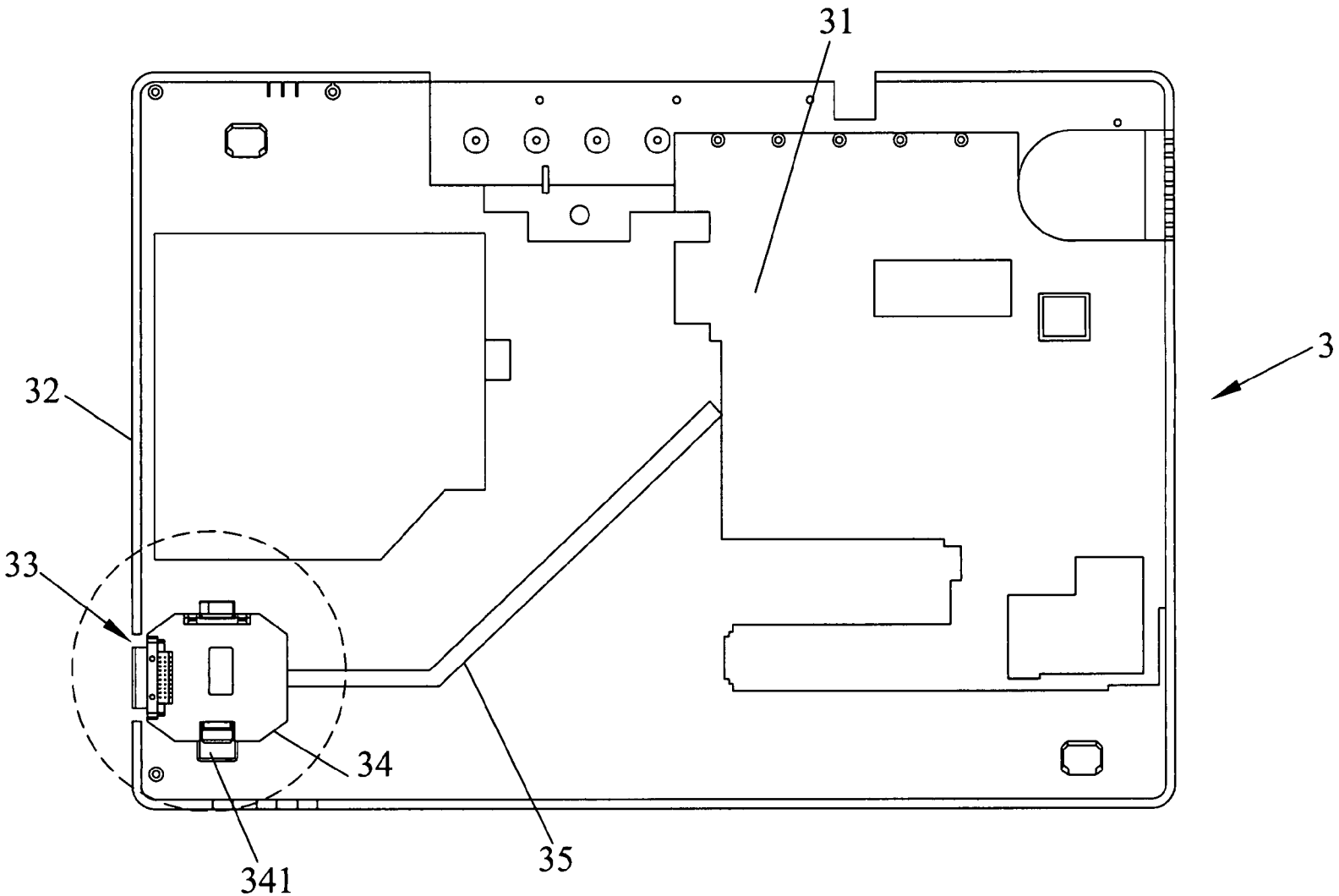
FIG. 2A is a top view showing the I/O port switch structure of the electronic device according to the invention.
Figure 2B:
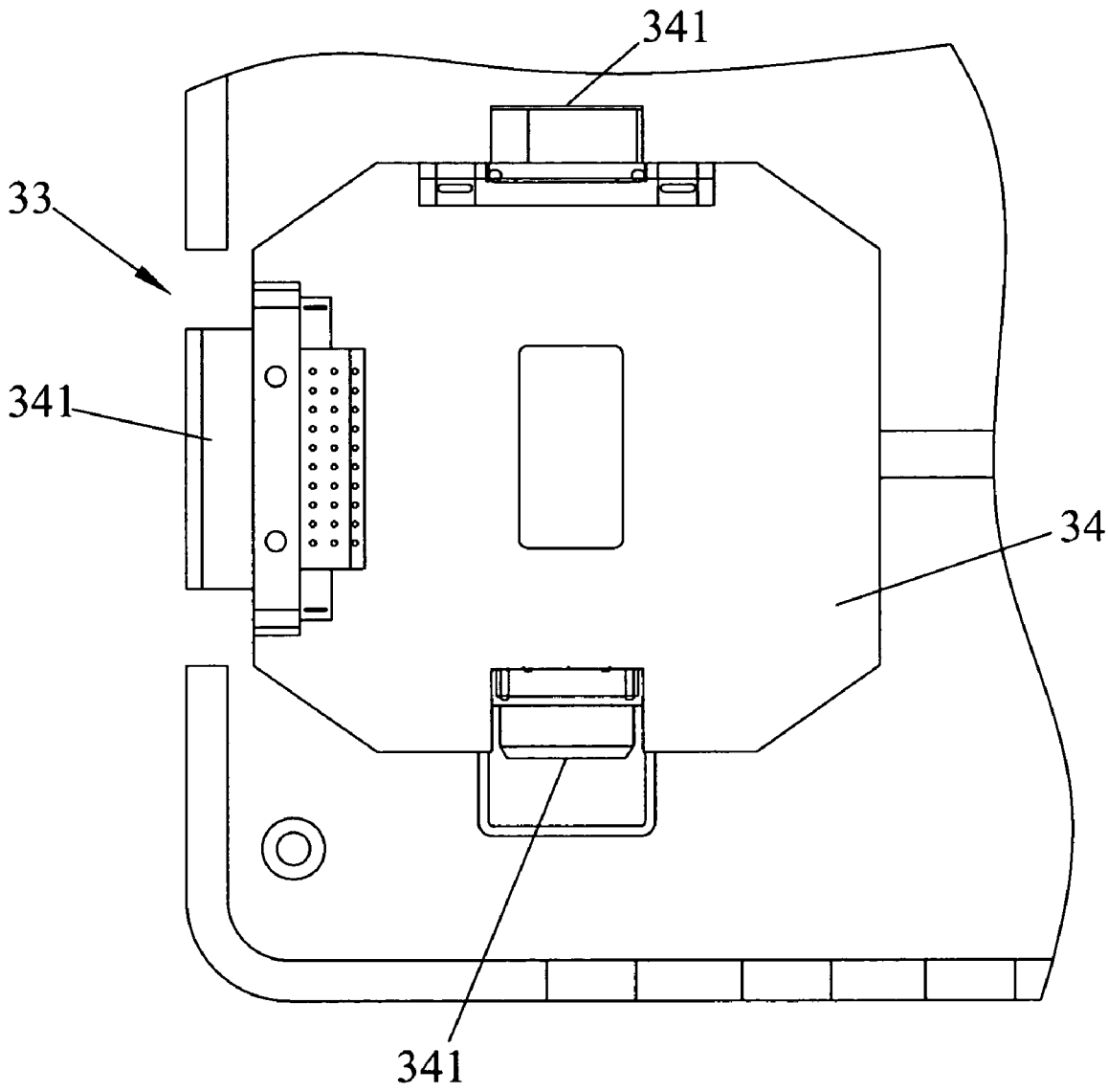
FIG. 2B is an enlarged perspective view showing the I/O port switch structure according to the invention.
Figure 2C:
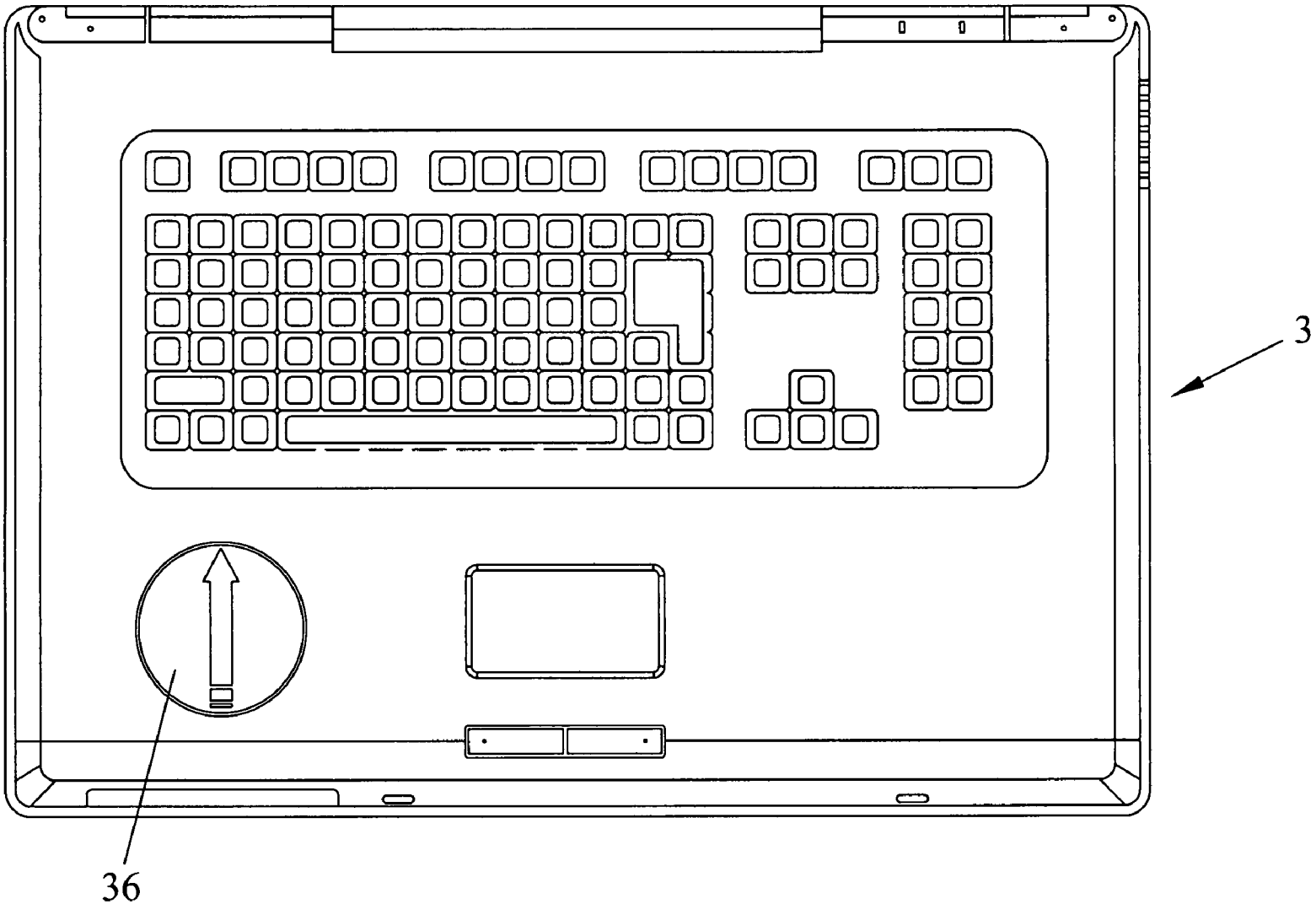
FIG. 2C is a top view showing the electronic device.

Referring to FIGS. 2A to 2C, a top view and an enlarged perspective view illustrate the embodiment of the I/O port switch structure of the electronic device according to the invention, and a top view of the embodiment of the electronic device of the invention is illustrated. According to FIG. 2A, a motherboard 31 is disposed in the electronic device 3 and an opening 33 is on the side 32 of the electronic device 3. The I/O port switch structure comprises a base 34, several I/O ports 341 and an operation portion 36 (as shown in FIG. 2C). The base 34 is electrically connected to the motherboard 31 through a cable 35, and the I/O ports 341 are installed on the base 34, wherein the electric signals received by the I/O ports 341 are transmitted to the motherboard 31 through the cable 35 for further processing. The operation portion 36 shown in FIG. 2C is connected to the base 34, and the user then operates the base 34 to perform a rotating motion at a predetermined angle, so that one of the I/O ports 341 can be rotated to the position corresponding to the opening 33, and the I/O ports 341 are therefore connected to an external device.

The electronic device 3 can be a notebook computer or a personal digital assistant (PDA), and the operation portion 36 can use a power driving method or a mechanical driving method to enable the base 34 to perform a rotating motion upon demands. The cable 35 comprises a plurality of signal transmission circuits corresponding to the I/O ports 341, and the cable 35 can be carried out by a single cable or a plurality of cables corresponding to the I/O ports 341, and these are all within the scope of the present invention.

Besides, the I/O port switch structure comprises a rotating limiting structure depending upon demands to restrict the rotating angle of the base 34 and preventing the I/O port switch structure from being damaged through improper operations of the user. The rotating limiting structure preferably comprises a first restriction element, a second restriction element and a limiting element. The first and the second restriction elements are installed on the base 34, and the limiting element is installed on the electronic device 3 and can closely approach the first or the second restriction element.

Thereby, the base 34 is restricted to perform a rotating motion between the first and the second restriction elements.

Besides, the I/O port switch structure comprises at least a positioning element and a positioning point upon demands. The positioning elements are installed on the base 34, and each position of the positioning element respectively corresponds to these I/O ports 341; and the positioning point is installed on the electronic device 3, and the position of the positioning point corresponds to the opening 33. When the base 34 is performing a rotating motion, the I/O ports 341 can accurately align the position of the opening 33 through the positioning elements and the positioning point.

Furthermore, since the sizes of different I/O ports 341 are different, intervals usually appear as the I/O ports 341 align the position of the opening 33. Therefore, the I/O ports 341 can further comprise a cover body upon demands, so that the cover body can align the opening 33 and approximately seal the opening 33 to keep a better appearance of the electronic device 3 as the I/O ports 341 are rotated to the position corresponding to the opening 33.

Please note that three I/O ports 341 are installed on the base 34 in the aforementioned embodiment, and this is only for example but not the limiting to the invention, two or four, or much more I/O ports 341 can be installed on the base 34 and these are all within the scope of the present invention.

Figure 3A:
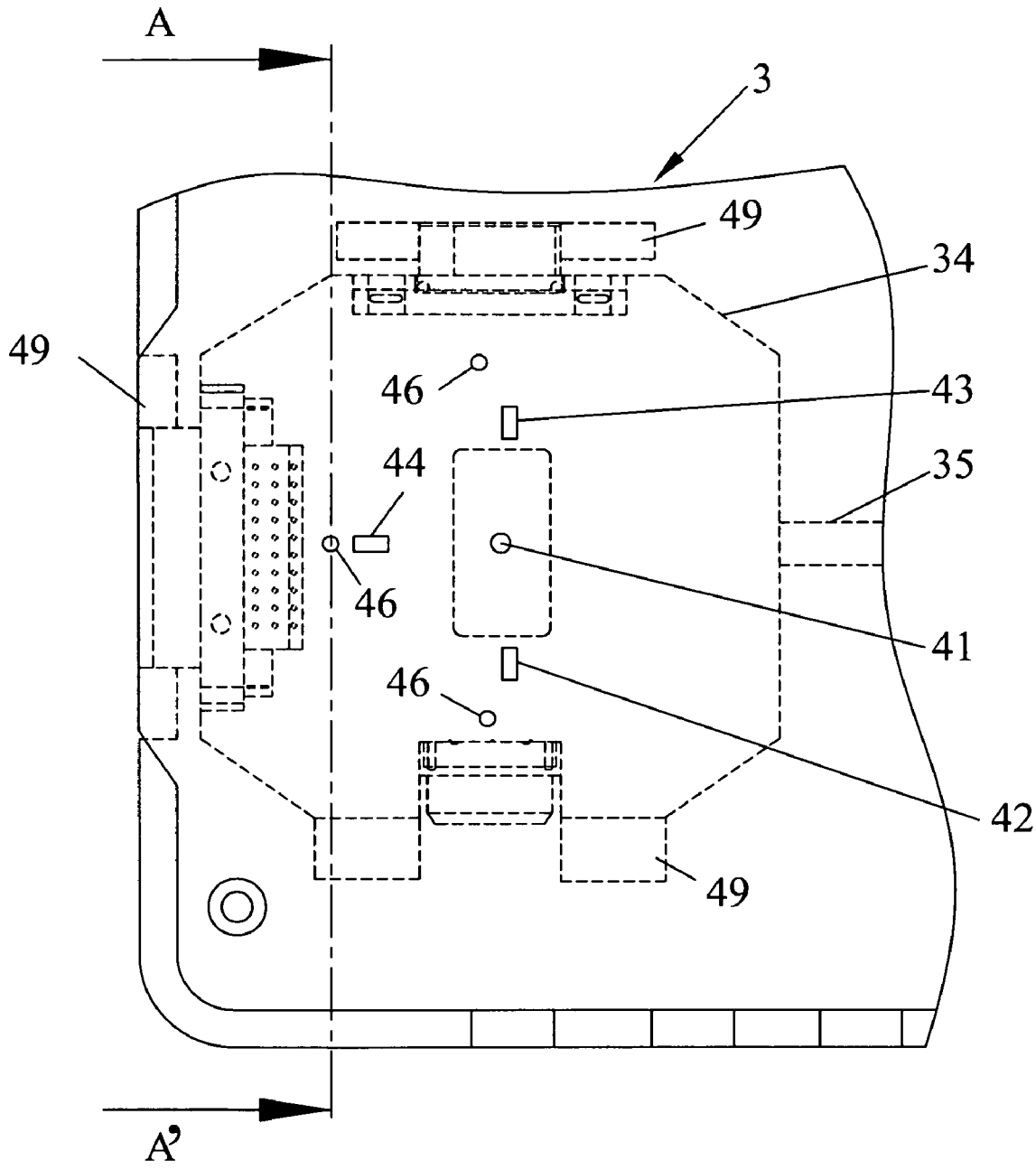
FIG. 3A is a top view showing the I/O port switch structure of an embodiment according to the invention.
Figure 3B:
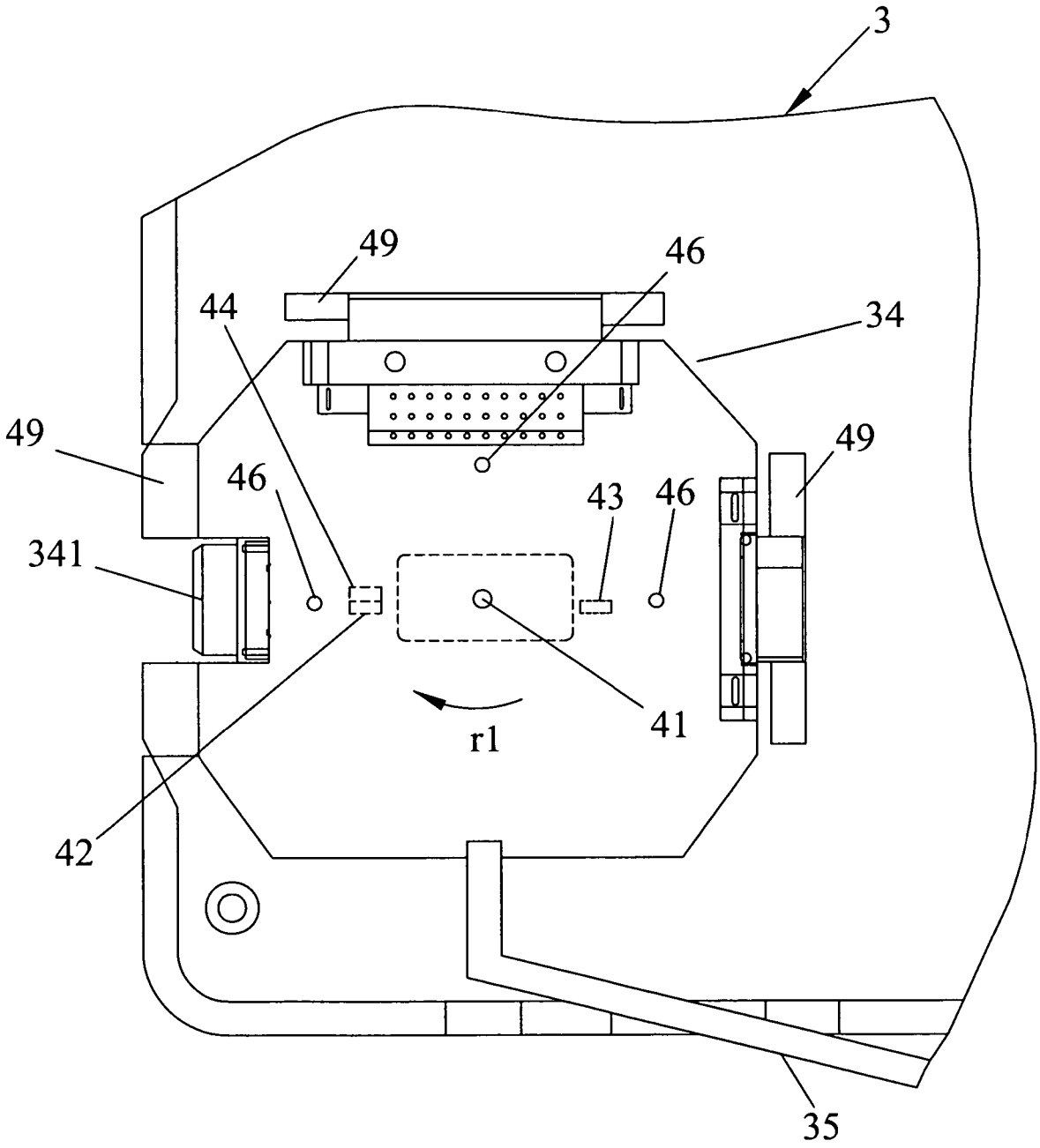
FIG. 3B is a schematic view showing the clockwise rotation of the base of another embodiment according to the invention.
Figure 3C:
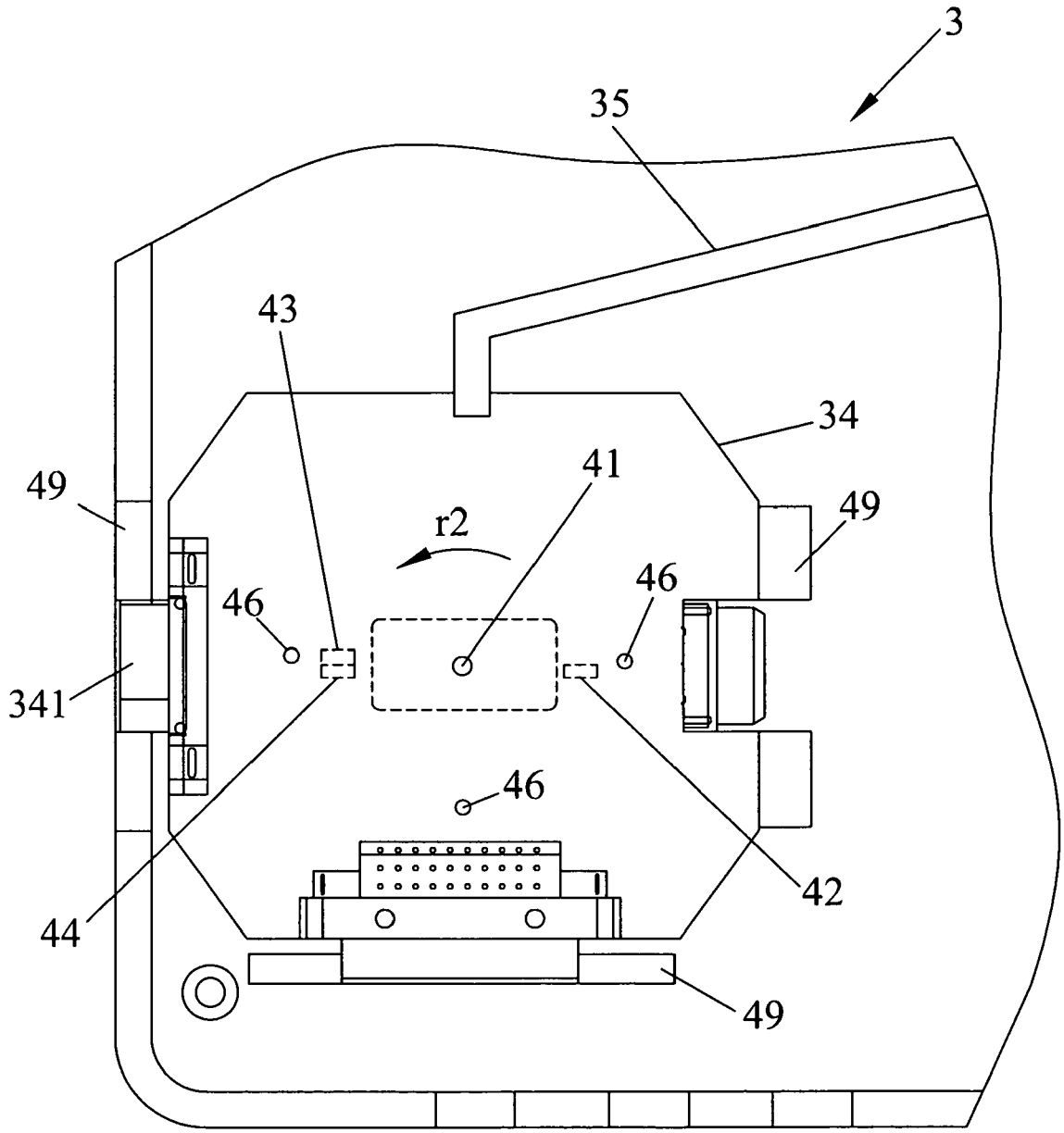
FIG. 3C is a schematic view showing the counter-clockwise rotation of the base of the other embodiment according to the invention.
Figure 3D:
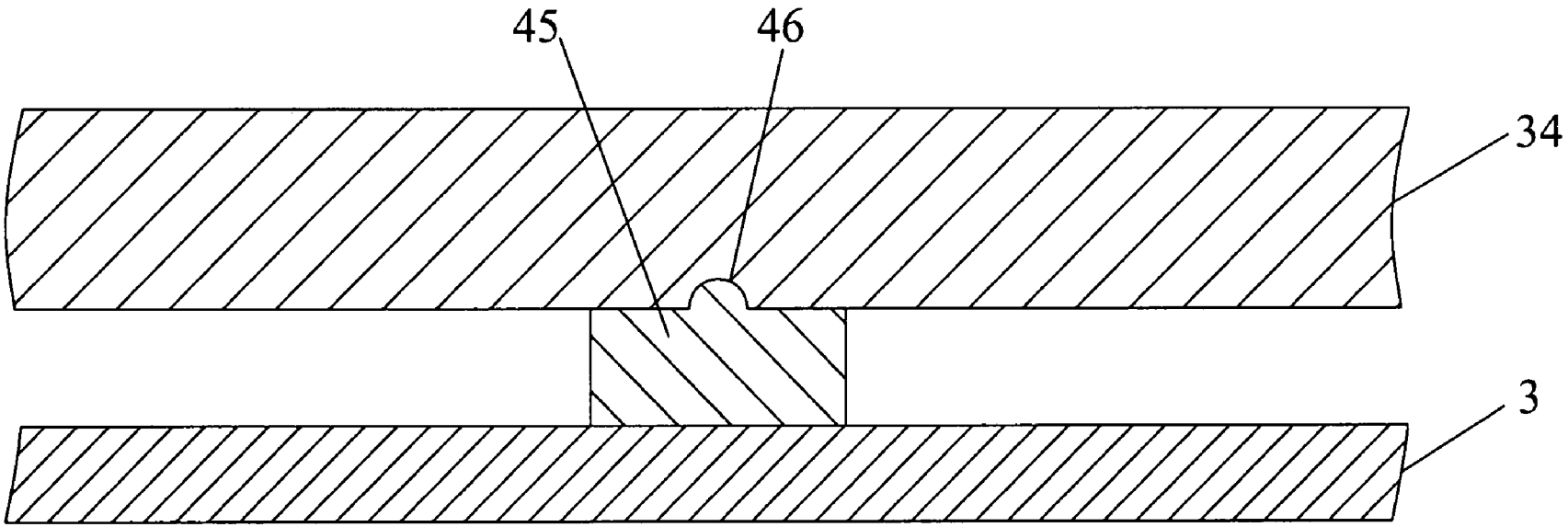
FIG. 3D is a sectional view showing the hatch line A-A' of FIG. 3A.

Referring to FIGS. 3A to 3D, a top view of the I/O port switch structure, a schematic view of the clockwise rotation of the base, a schematic view of the counter-clockwise rotation of the base and a sectional view of the hatch line A-A' according to FIG. 3A of the other embodiment are illustrated. According to FIG. 3A, three I/O ports 341 are installed on the base 34, wherein the base 34 is pivotally connected to the electronic device 3 through a spindle 41, and the base 34 can be rotated through the spindle 41. A first restriction element 42 and a second restriction element 43 are disposed on the surface of the base 34 closely approached to the electronic device 3, and a position limiting element 44 is installed on the electronic device 3. These elements are used to restrict the rotating angle of the base 34. The electronic device 3 comprises a positioning point 45 (as shown in FIG. 3D) and the base 34 comprises a plurality of positioning elements 46, wherein each positioning element 46 respectively corresponds to an I/O port 341, and the positioning point 45 can be inserted with the positioning elements 46 as shown in FIG. 3D. The positioning point 45 can be installed on the position limiting element 44 upon demands.

Referring to FIG. 3B, as a user rotates the base 34 in the clockwise direction r1 through the operation portion, the first restriction element 42 will closely approach the position limiting element 44, so that the base 34 can not be continuously rotated in the clockwise direction r1 to prevent the cable 35 from being snapped due to the excessive rotation of the base 34. The positioning point 45 is also inserted into one of the positioning elements 46, so that the one of the I/O ports 341 aligns the opening 33 much more accurately.

Referring to FIG. 3C, as a user rotates the base 34 in the counter-clockwise direction r2 through the operation portion, the second restriction element 43 will closely approach the limiting element 44, so that the base 34 can not be continuously rotated in the counter-clockwise direction r2. The positioning point 45 is also inserted into the other one of the positioning elements 46, so that the other one of the I/O ports 341 aligns the opening 33. By way of the operating relationship among the first limiting element 42, the second limiting element 43 and the position limiting element 44, the rotating angle of the base 34 can be restricted to prevent the cable 35 from being snapped due to the excessive rotation of the base 34. Since the positioning point 45 is respectively inserted into different positioning elements 46, the I/O ports 341 can be further accurately rotated to the opening 33 when the base rotates. The positioning element 46 and the positioning point 45 shown in FIG. 3D are only for example but not limiting to the present invention. Any structure, which can achieve the positioning effect, is all within the scope of the subject invention.

Comparing with FIGS. 2A and 2B, the I/O ports 341 shown in FIGS. 3A to 3C comprise a cover plate 49. The opening can be approximately sealed by the cover plate 49 to keep a better appearance of the electronic device 3 when one, of the I/O ports 341 aligns the opening 33.

The above examples are intended for illustrating the embodiments of the present invention, but not for restricting the scope of protection of the present invention. Any modification or equivalent arrangements which belong to the spirit and category of the invention should be within the scope based on the claims as appended.

What is claimed is:

1. An input/output (I/O) port switch structure of an electronic device, the electronic device having a motherboard and an opening, the I/O port switch structure comprising:

a base having a plurality of I/O ports with predetermined arrangement, and connected to the motherboard through a cable; and an operation portion connected to the base, and for enabling the base to perform a rotating motion at a predetermined angle to switch the position of one of the I/O ports corresponding to the opening.

2. The I/O port switch structure according to claim 1, wherein the I/O port further comprises a cover plate, so that the opening can be approximately sealed by the cover plate when the I/O port aligns the opening.

3. The I/O port switch structure according to claim 1, further comprising a rotating limiting structure for restricting the rotating angle of the base.

4. The I/O port switch structure according to claim 3, wherein the rotating limiting structure comprises a first restriction element, a second restriction element and a limiting element, wherein the first restriction element and the second restriction element are installed on the base; and the limiting element is installed on the electronic device, so that the base can perform a rotating motion between the first and the second restriction elements.

5. The I/O port switch structure according to claim 1, further comprising a plurality of positioning elements and a positioning point, wherein these positioning elements are installed on the base, and the position of every positioning element respectively corresponds to the I/O ports; and the positioning point is installed on the electronic device, and the position of the positioning point corresponds to the opening.

6. The I/O port switch structure according to claim 1, wherein the operation portion lets the base perform a rotating motion by a power driving method.

7. The I/O port switch structure according to claim 1, wherein the operation portion lets the base perform a rotating motion by a mechanical driving method.

8. The I/O port switch structure according to claim 1, wherein the cable comprises a plurality of signal transmission circuits corresponding to the I/O ports.

9. The I/O port switch structure according to claim 1, wherein the electronic device can be a notebook or a personal digital assistant (PDA).

* * * * *